US012090536B2

(12) United States Patent
Liu et al.

(10) Patent No.: US 12,090,536 B2
(45) Date of Patent: Sep. 17, 2024

(54) HOT EXTRUSION DIE AND HOT EXTRUSION INTEGRAL FORMING METHOD FOR SPECIAL-SHAPED SQUARE PIPE

(71) Applicants: CENTRAL IRON AND STEEL RESEARCH INSTITUTE, Beijing (CN); HANDAN XINXING SPECIAL STEEL PIPES CO. , LTD., Beijing (CN)

(72) Inventors: Zhenbao Liu, Beijing (CN); Xiaohui Wang, Beijing (CN); Jianxiong Liang, Beijing (CN); Yongqing Sun, Beijing (CN); Changjun Wang, Beijing (CN); Zhiyong Yang, Beijing (CN); Yuguang Gao, Beijing (CN); Jie Gao, Beijing (CN); Fuqiang Liu, Beijing (CN); Ailiang Zhang, Beijing (CN)

(73) Assignees: CENTRAL IRON AND STEEL RESEARCH INSTITUTE, Beijing (CN); HANDAN XINXING SPECIAL STEEL PIPES CO., LTD., Beijing (CN)

( * ) Notice: Subject to any disclaimer, the term of this patent is extended or adjusted under 35 U.S.C. 154(b) by 0 days.

(21) Appl. No.: 17/766,664

(22) PCT Filed: Apr. 15, 2021

(86) PCT No.: PCT/CN2021/087462
§ 371 (c)(1),
(2) Date: Apr. 5, 2022

(87) PCT Pub. No.: WO2021/208999
PCT Pub. Date: Oct. 21, 2021

(65) Prior Publication Data

US 2024/0082897 A1 Mar. 14, 2024

(30) Foreign Application Priority Data

Apr. 15, 2020 (CN) ..... 202010297114.2

(51) Int. Cl.
*B21C 23/08* (2006.01)

(52) U.S. Cl.
CPC ..... *B21C 23/085* (2013.01)

(58) Field of Classification Search
CPC ..... B21C 23/08; B21C 23/085; B21C 23/142; B21C 25/02; B21C 29/003; B21C 37/155
See application file for complete search history.

(56) References Cited

U.S. PATENT DOCUMENTS

2019/0275576 A1* 9/2019 Matsui ..... B21C 23/085

FOREIGN PATENT DOCUMENTS

CN 103769812 A 5/2014
CN 105414240 A 3/2016
(Continued)

OTHER PUBLICATIONS

International Search Report in International Appl. No. PCT/CN2021/087462, dated Jul. 22, 2021, 4 pages.

*Primary Examiner* — Debra M Sullivan
(74) *Attorney, Agent, or Firm* — Bochner PLLC; Andrew D. Bochner

(57) ABSTRACT

A hot extrusion die for a special-shaped square pipe includes a die cavity sleeve with a special-shaped cavity. A hot extrusion mandrel is arranged in the die cavity sleeve. An area between the die cavity sleeve and the hot extrusion mandrel forms a die cavity hole. A first extrusion diversion hole and a second extrusion diversion hole are arranged below the die cavity hole. An integral centroid of the die cavity hole is located at a circle center of a radial cross section of the die cavity sleeve. Further disclosed is a hot extrusion integral forming method for a special-shaped
(Continued)

square pipe, including: heating and expanding a blank material; heating the blank material again after expanding; performing hot extrusion on the blank material; and cooling the formed special-shaped square pipe in air to a room temperature, and inspecting surface quality and mechanical properties of the special-shaped square pipe.

10 Claims, 4 Drawing Sheets

(56) References Cited

FOREIGN PATENT DOCUMENTS

| | | | | | |
|---|---|---|---|---|---|
| CN | 107350301 | A | * | 11/2017 | ..... B21C 25/02 |
| CN | 109604360 | A | * | 4/2019 | ..... B21C 23/02 |
| CN | 209287987 | U | | 8/2019 | |
| CN | 111451309 | A | | 7/2020 | |
| JP | 1029011 | A | | 2/1998 | |

* cited by examiner

A–A

B–B

HOT EXTRUSION DIE AND HOT EXTRUSION INTEGRAL FORMING METHOD FOR SPECIAL-SHAPED SQUARE PIPE

CROSS REFERENCE TO RELATED APPLICATION

This patent application claims the benefit and priority of Chinese Patent Application No. 202010297114.2 filed on Apr. 15, 2020, the disclosure of which is incorporated by reference herein in its entirety as part of the present application.

TECHNICAL FIELD

The present disclosure relates to the technical fields of extrusion forming and special-shaped material manufacturing, and in particular, to a hot extrusion die and a hot extrusion integral forming method for a special-shaped square pipe.

BACKGROUND ART

A special-shaped square pipe belongs to a particular special-shaped material, which is applied to the fields of petroleum, chemical industry, civil aircraft, commercial ships, civil ships, etc., and is a good load bearing structure due to streamline property of its shape.

In China, a forming method for this special-shaped square pipe generally adopts a method of welding after splicing. However, the special-shaped square pipe integrally formed by a hot extrusion method has not been reported in a literature.

A hot extrusion integral forming method can realize one-time forming and ensures property and dimension requirements, but difficulties also lie in such forming method; regarding heating process, design of tool and die, lubrication effect, and deformation process, no matter which one of them has a problem, it can result in failure of such forming method.

In addition, the cross section of the existing hot extrusion material is of an asymmetric structure and tends to deform seriously. If a heating temperature for a blank material is too high, then grains in a structure tend to be coarse easily. If the heating temperature is too low, then greater extrusion force is needed, so a phenomenon that an extruder cannot extrude occurs, thereby reducing service life of the die.

SUMMARY

In view of the abovementioned analysis, an objective of the embodiments of the present disclosure is to provide a hot extrusion die and a hot extrusion integral forming method for a special-shaped square pipe, which are used for solving the problem in the prior art that the special-shaped square pipe cannot be prepared by the hot extrusion integral forming method.

The objective of the present disclosure is mainly achieved by the following technical solutions.

It is provided a hot extrusion die for a special-shaped square pipe, including a die cavity sleeve with a special-shaped cavity. A hot extrusion mandrel is arranged in the die cavity sleeve; an area between the die cavity sleeve and the hot extrusion mandrel forms a die cavity hole for the special-shaped square pipe.

A first extrusion diversion hole and a second extrusion diversion hole are arranged below the die cavity hole. The die cavity sleeve is shaped into a cylinder; a centroid of the die cavity hole is located at a circle center of a radial cross section of the die cavity sleeve; and an angle a2 formed between two end faces of the die cavity sleeve is in a range of 1° to 2°, preferably 1.5° to 1.7°.

In some embodiments, an outer diameter of the die cavity sleeve is in a range of 415 mm to 416 mm. A three-dimensional Cartesian coordinate system is established on a radial cross section of the hot extrusion die by assuming the circle center of the radial cross section of the die cavity sleeve as an original point, and has an X-axis direction in a transverse direction and a Y-axis direction in a longitudinal direction. A thickness of the die cavity sleeve in a Z-axis direction is in a range of 20 to 40 mm; both the die cavity sleeve and the mandrel are symmetrical about the Y axis. The first extrusion diversion hole and the second extrusion diversion hole are arranged symmetrically about the Y axis.

In some embodiments, the special-shaped cavity includes a first rectangular cavity and a second rectangular cavity connected with each other; the first rectangular cavity is arranged above the second rectangular cavity, and a length of the first rectangular cavity is greater than that of the second rectangular cavity.

A convex portion is formed at a central position of a top of the first rectangular cavity, and a concave arc-shaped portion is formed at a central position of the convex portion.

In some embodiments, first rounded corners R1 and R4 are formed at connections between the first rectangular cavity and the second rectangular cavity; a chamfer a1 of 45° is formed at each of two sides of the top of the first rectangular cavity; second rounded corners are formed at two corners symmetric about the Y axis, at a bottom of the second rectangular cavity, and a size of the second rounded corners are 20.26 mm.

Third equal rounded corners R2, R3, R5, and R6 are respectively formed at four corners of the mandrel, and a size of the third rounded corners R2, R3, R5, and R6 are all equal to 10.3 mm.

In some embodiments, both the first extrusion diversion hole and the second extrusion diversion hole are circular holes; fourth rounded corners of the first extrusion diversion hole and the second extrusion diversion hole are R9 and R10 respectively; the mandrel and a long side of the first rectangular cavity form a wide portion of the die cavity hole, and the mandrel and the second rectangular cavity form a narrow portion of the die cavity hole.

At a feeding end of the hot extrusion die, a fifth rounded corner R11 is formed at the wide portion of the die cavity hole of the die cavity sleeve; and a sixth round corner is formed at the narrow portion of the die cavity hole of the die cavity sleeve, and a size of the fourth round corner and the fifth rounded corner are 15.

On the other hand, it is provided a hot extrusion integral forming method for a special-shaped square pipe by using the hot extrusion die, including following steps:

- heating and expanding step configured for, performing heating and expanding on a blank material;
- heating step configured for, heating the blank material again after the expanding;
- hot extrusion step configured for, performing hot extrusion on the blank material by the hot extrusion die; and
- cooling step configured for, cooling the special-shaped square pipe formed by the hot extrusion, in air, to a room temperature, and inspecting surface quality and mechanical properties of the special-shaped square pipe.

Furthermore, in the heating and expanding step, an annular furnace is used for heating, a heating rate is 50 to 100° C./h, the blank material is heated to 940 to 960° C. and heat-preserved for 4 to 5 h; and after heat preservation treatment, the blank material is heated to 1150 to 1180° C. by a first induction furnace and taken out from the first induction furnace.

Furthermore, in the heating and expanding step, the expanding is performed on the heated blank material by a hole expanding head of a 60/240 mm at a hole expanding speed of 100 to 250 mm/s.

Furthermore, in the heating step, the heating includes placing the expanded blank material into the annular furnace for heating, at a heating rate of 50 to 100° C./h, the expanded blank material is heated to 940 to 960° C. and heat-preserved for no less than 1 h; and after heat preservation treatment, the blank material is heated to 1190 to 1220° C. by a second induction furnace and taken out from the second induction furnace after a temperature of the blank material is equalized.

Furthermore, in the hot extrusion step, performing hot extrusion on the heated blank material by the hot extrusion die, wherein an extrusion force is no more than 60 MN, and an extrusion speed is in a range of 200 to 300 mm/s.

Compared with the prior art, the prevent disclosure has at least one of the following beneficial effects.

(1) A hole and a trumpet opening are prefabricated in the blank material before expanding, which improves accuracy of hole location of the expanded hole and improves uniformity of the wall thickness of the blank material. Descaling treatment is performed before the expanding and hot extrusion, which removes surface oxide scale, prevents the oxide scale from entering the blank material during thermal deformation, improves the product quality and the surface quality of the product.

(2) The hot extrusion is performed after the blank material is heated to 1190 to 1220° C. during second induction heating, which reduces resistance to deformation during depressurization, and also avoids formation of high temperature ferrite.

(3) The hot extrusion die for the special-shaped square pipe includes the mandrel and the die cavity sleeve, and two extrusion diversion holes are arranged below the die cavity, so that the integral centroid of the die cavity hole is located at a position of a circle center of a circular surface of the die cavity sleeve, which reduces the deformation during hot extrusion and solves a difficult problem of metal filling for the special-shaped square pipe. The die cavity sleeve of the present disclosure is a cylinder. An angle a1 formed between two end faces of the cylinder is 1° to 2°. During hot extrusion, when the blank material is in contact with the narrow portion of the die cavity hole first, great deformation and strain at the narrow portion of the die cavity hole during the hot extrusion can be avoided.

(4) According to the special-shaped square pipe prepared by the hot extrusion integral forming method of the present disclosure, the special-shaped square pipe has good surface quality and dimension accuracy within an error range. Through physical and chemical analysis and mechanical property tests, all of the property indexes of the special-shaped square pipe meet design requirements, and the overall quality thereof meets requirements of industrial application.

In the present disclosure, the abovementioned technical solutions may also be combined with one another to realize more preferable combination solutions. Others features and advantages of the present disclosure will be illustrated in subsequent specification, and in addition, some advantages can become apparent from the specification, or be understood by implementing the present disclosure. The objective and other advantages of the present disclosure can be implemented and achieved by the content particularly specified in the embodiments and drawings of the specification.

BRIEF DESCRIPTION OF THE DRAWINGS

Drawings are only intended to illustrate specific embodiments and are not construed as a limitation to the present disclosure. Throughout the drawings, same reference signs represent same components.

LIST OF REFERENCE NUMBERS

Figure 1:
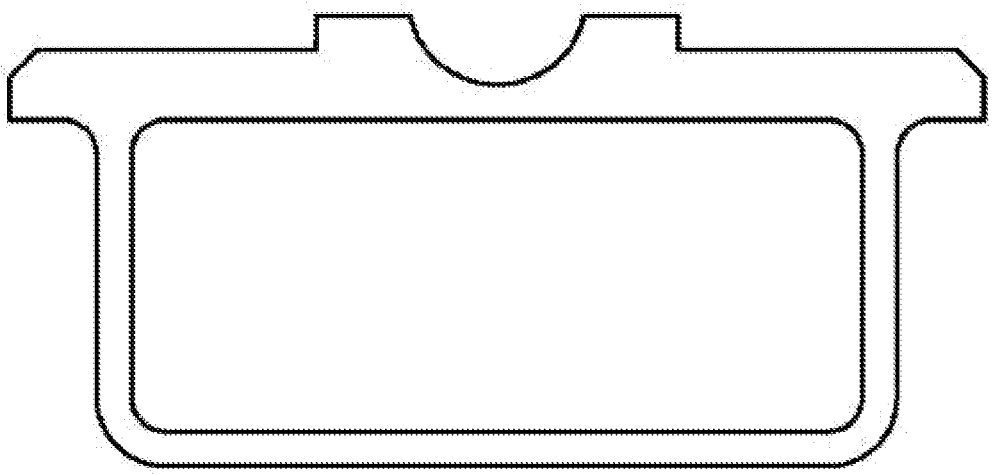
FIG. 1 is a schematic cross-sectional view of a special-shaped square pipe.

1 die cavity sleeve; 2 mandrel.

DETAILED DESCRIPTION OF THE EMBODIMENTS

Preferred embodiments of the present disclosure will be described in detail below in combination with the drawings. The drawings form a part of the present disclosure and are used to explain the principles of the present disclosure together with the embodiments of the present disclosure, but are not intended to limit the scope of the present disclosure.

Embodiment 1

In this embodiment, it is provided a hot extrusion die for a special-shaped square pipe, as shown in FIG. 1 and FIGS. 3 to 5, including a die cavity sleeve 1 with a special-shaped cavity. A hot extrusion mandrel 2 is arranged in the die cavity sleeve 1. An area between the die cavity sleeve 1 and the hot extrusion mandrel 2 forms a die cavity hole for the special-shaped square pipe. A first extrusion diversion hole and a second extrusion diversion hole are arranged below the die cavity hole for the special-shaped square pipe. An outer contour of the die cavity sleeve 1 is a cylinder. An integral centroid of the die cavity hole for the special-shaped square pipe is located at a position where a circle center of a vertical truncated circular surface of the die cavity sleeve 1 lies.

Specifically, the hot extrusion die provided by the present disclosure is used for extruding the special-shaped square pipe. The hot extrusion die includes the die cavity sleeve 1 provided with the special-shaped cavity therein. The shape of the special-shaped cavity forms an outer contour of the special-shaped square pipe. The mandrel 2 is fixed within the die cavity sleeve 1. The outer contour of the mandrel 2 forms an internal contour of the die cavity hole for the special-shaped square pipe. The first extrusion diversion hole and the second extrusion diversion hole are arranged below the die cavity hole for the special-shaped square pipe. The first extrusion guide hole and the second extrusion guide hole function to reduce deformation of an extrusion material. When a blank material is extruded, the blank material enters the die cavity hole for the special-shaped square pipe through the die cavity hole formed by the die cavity sleeve 1 and the mandrel 2, so as to obtain the special-shaped square pipe by extruding.

It is to be noted that great extent of deformation is caused due to the fact that, the special-shaped square pipe of the present disclosure belongs to an asymmetric structure in which an upper portion is not symmetric with an lower portion thereof, a die cavity area of an upper half portion of the die cavity is much larger than that of a lower half portion of the die cavity, a length of the extrusion material flowing through the upper half portion of the die cavity is shorter during extrusion, and a length of the extrusion material flowing through the lower half portion of the die cavity is longer. The die cavity area of the lower half portion is increased by providing the first diversion hole and the second diversion hole, and the centroid of the special-shaped square pipe is overlapped with the circle center of the cylindrical die cavity sleeve 1, thereby ensuring the symmetry of the die cavity. Due to the addition of the first diversion hole and the second diversion hole, a part of the extrusion material flows out from the first diversion hole and the second diversion hole, so as to reduce the length of the extrusion material flowing through the lower half portion and reduce deformation of the extrusion material.

In the prior art, a special-shaped square pipe is generally extruded by a method of welding after splicing. However, in the present disclosure, the die cavity hole for the special-shaped square pipe is formed by fixing the mandrel 2 within the die cavity sleeve 1, which can realize integrated preparation of the special-shaped square pipe. The special-shaped square pipe is extruded by the hot extrusion die provided by the present disclosure, which can avoid great bending deformation of the special-shaped square pipe, and can meet use requirements. The use requirements include keeping the extrusion material in the shape of the die cavity and keeping the bending deformation of the extrusion material less than 5 cm/m.

According to the present disclosure, a three-dimensional Cartesian coordinate system is established on a radial cross section of the hot extrusion die by taking the circle center of the radial cross section of the die cavity sleeve 1 as an original point. The transverse direction is an X-axis direction, and the longitudinal direction is a Y-axis direction. The outside diameter of the die cavity sleeve 1 is within a range of 415 to 416 mm. A thickness of the die cavity sleeve 1 in a Z-axis direction is within a range of 20 to 40 mm. Both the die cavity sleeve 1 and the mandrel 2 are symmetric about a Y axis. The first extrusion diversion hole and the second extrusion diversion hole are arranged symmetrically about the Y axis.

Specifically, the outer contour of the die cavity sleeve 1 is a cylinder. A coordinate system is established on the radial cross section of the die cavity sleeve 1, the circle center of the radial cross section of the die cavity sleeve 1 is taken as an original point, the thickness direction of the die cavity sleeve 1 is taken as a Z axis, that is, the thickness of the die cavity sleeve 1 in the Z-axis direction is within a range of 20 to 40 mm. The die cavity sleeve 1 and the mandrel 2 are arranged symmetrically about the Y-axis, that is, the die cavity hole for the special-shaped square pipe die formed by the die cavity sleeve 1 and the mandrel 2 is symmetric about the Y axis. The first extrusion diversion hole and the second extrusion diversion hole below the die cavity hole for the special-shaped square pipe are symmetric about the Y axis.

The special-shaped cavity of the present disclosure includes a first rectangular cavity and a second rectangular cavity connected with each other. The first rectangular cavity is arranged above the second rectangular cavity, and the length of the first rectangular cavity is greater than that of the second rectangular cavity. A convex portion is provided in a middle position of the top of the first rectangular cavity, and a concave arc-shaped portion is provided in a middle position of the convex portion.

Figure 3:
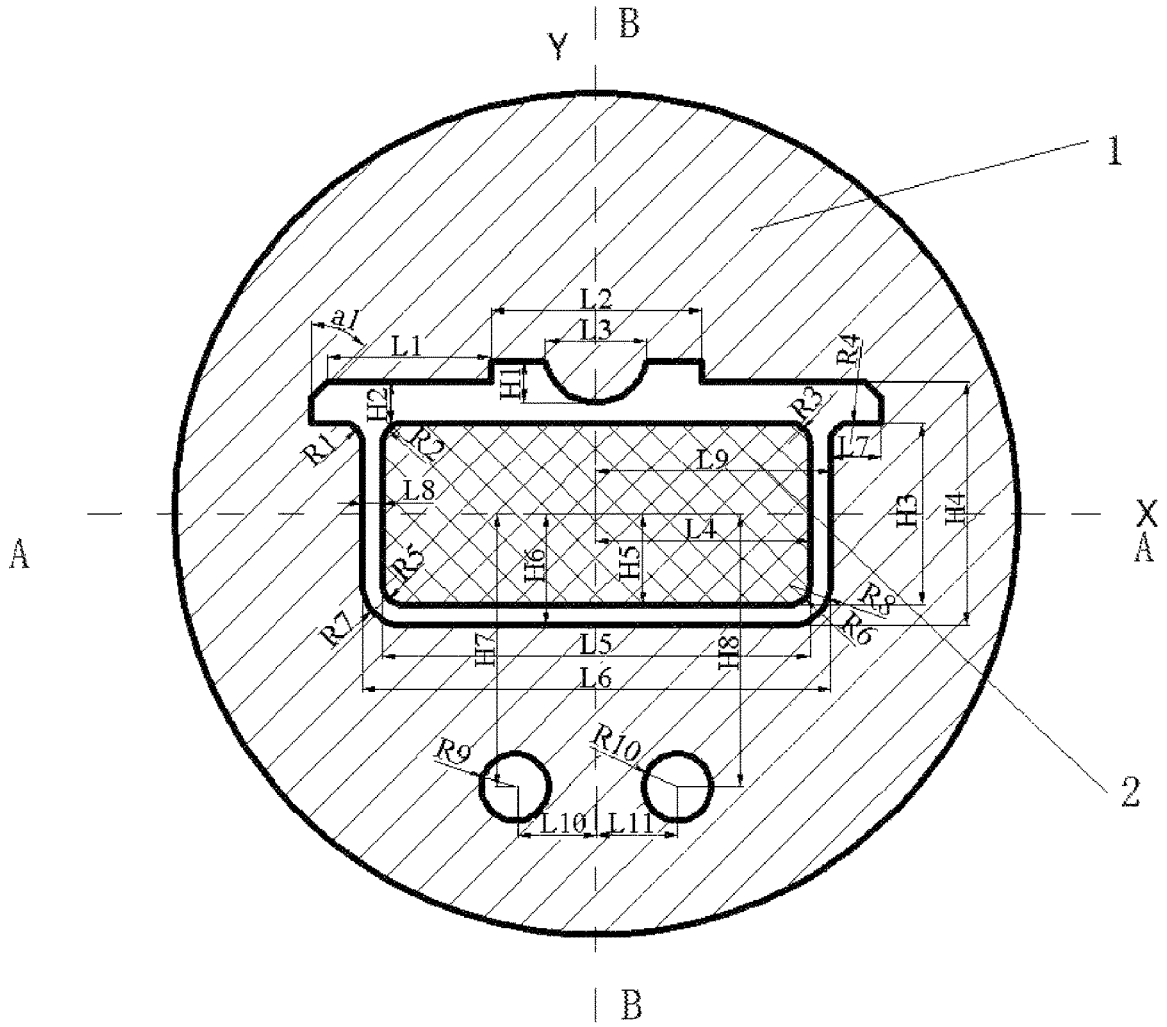
FIG. 3 is a schematic structural diagram of a hot extrusion die.

Specifically, as shown in FIG. 3, the outer contour of the special-shaped cavity inside the die cavity sleeve 1 forms the outer contour of the special-shaped square pipe. In the present application, for facilitating description, the special-shaped cavity is divided into a first rectangular cavity and a second rectangular cavity connected to each other (the special-shaped cavity is actually of an integral structure). The first rectangular cavity is located above the second rectangular cavity. The length of the long side of the first rectangular cavity in the X-axis direction is greater than that of the long side of the second rectangular cavity in the X-axis direction. The extra portions, relative to the second rectangular cavity, of the first rectangular cavity at two ends thereof form two flanges. The two flanges are also symmetric about the Y axis. The convex portion is provided in the middle position of the top of the first rectangular cavity, and the outer contour of the convex portion is a rectangle. A concave arc-shaped portion is provided in the middle position of the top of the convex portion. Both the convex portion and the arc-shaped portion thereon are provided symmetrically about the Y axis.

As shown in FIG. 1 and FIG. 3, rounded corners R1 and R4 are respectively provided at connections symmetric about the Y axis, where the first rectangular cavity is connected with the second rectangular cavity, with R1=R4=10.2 mm. The rounded corners R1 and R4 are used for controlling the shape of the extrusion material, that is, the place where one surface is perpendicular to another surface is transited by a rounded corner. Considering shrinkage after pressurization, the rounded corners R1 and R4 of the extrusion material are controlled to be 10.2 mm.

As shown in FIG. 1 and FIG. 3, the length L2 of the convex portion along the X axis is 108.5 mm. The arc length L3 of the arc-shaped portion along the X axis is 50.15 mm. A height H1 from a bottommost end of the arc-shaped portion to a top end of the convex portion is 22.26 mm. The length of the first rectangular cavity along the X axis is equal to L6+2L7, L6=240.1 mm, and L7=24.55 mm. The width H2 of the first rectangular cavity along the Y axis is equal to 23.31 mm, and chamfers a1 formed at two sides of the top of the first rectangular cavity are 45°.

As shown in FIG. 3, the length L6 of the second rectangular cavity along the X axis is 240.1 mm, the width H4 of the second rectangular cavity along the Y axis is 129.1 mm, the distance H6 from the long side of the first rectangular cavity to the X axis is 58.87 mm, and rounded corners R7 and R8 are provided at two corners symmetric about the Y axis, of the bottom of the second rectangular cavity, R7=R8=20.26 mm. The rounded corners R7 and R8 are provided to control the shape of the extrusion material, that is, the place where one surface is perpendicular to the other surface vertical surfaces of the special-shaped square pipe are transited by a rounded corner. The rounded corner of the extrusion material is controlled to be 20.26 mm in consideration of shrinkage after pressurization.

As shown in FIG. 3, the mandrel 2 is rectangular. The length L2 of the mandrel 2 along the X axis is 216.5 mm. The width H3 of the mandrel 2 along the Y axis is 93.84 mm. The distance H5 from the long side of the mandrel 2 to the X axis is 46.92 mm. The distance L4 from the short side of the mandrel 2 to the Y axis is 108.25 mm. Equal rounded corners R2, R3, R5, and R6 are formed at the four corners of the mandrel 2, and the rounded corners R2, R3, R5, and R6 are all equal to 10.3 mm.

Both the first extrusion diversion hole and the second extrusion diversion hole are circular holes. The distances from the circle centers of the first extrusion diversion hole and the second extrusion diversion hole to the X axis are H7 and H8 respectively, and H7=H8=102 mm. The rounded corners of the first extrusion diversion hole and the second extrusion diversion hole are R9 and R10 respectively, and R9=R10=20 mm. The distance from the circle center of the first extrusion diversion hole to the Y axis is L10, and the distance from the circle center of the second extrusion diversion hole to the Y axis is L11, and L10=L11=39.05 mm.

As shown in FIG. 3, the mandrel 2 and the long side of the first rectangular cavity form a wide portion (including the flanges at the two ends) of the die cavity hole, the mandrel 2 and the second rectangular cavity form a narrow portion of the die cavity hole, and the width L8 of the narrow portion of the die cavity hole is 11.8 mm.

Figure 4:
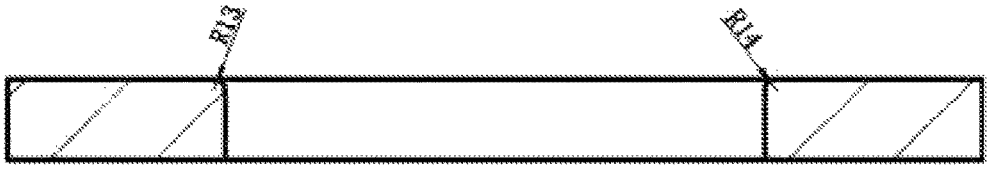
FIG. 4 is a view of a die cavity sleeve as viewed along an A-A direction in FIG. 3.
Figure 5:
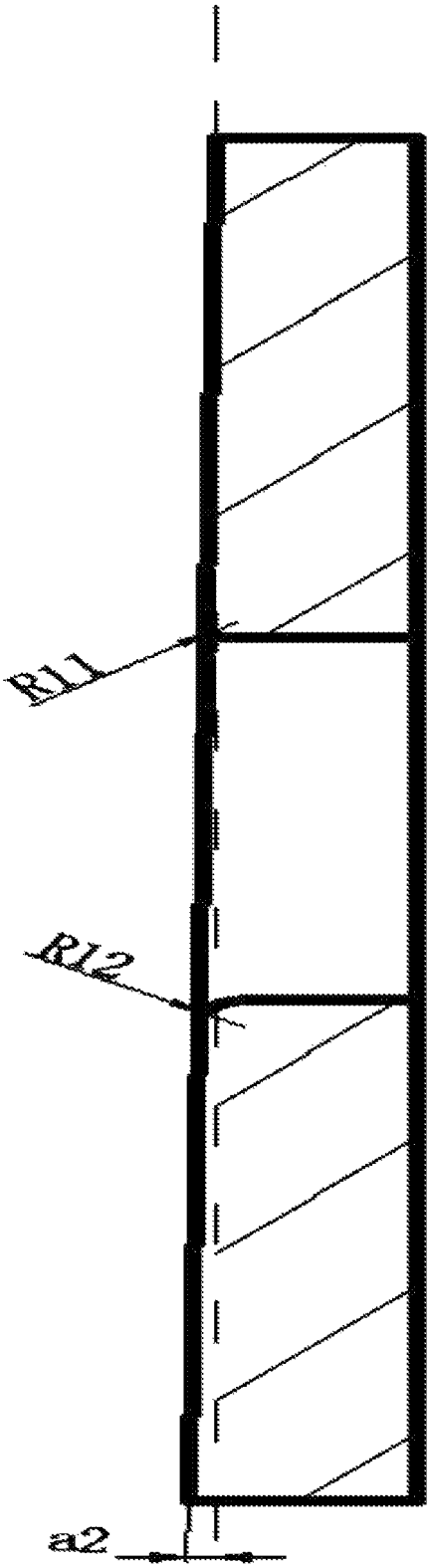
FIG. 5 is a view of the die cavity sleeve as viewed along a B-B direction in FIG. 3.

As shown in FIG. 4 and FIG. 5, at a feeding end of the hot extrusion die, a rounded corner R11 is formed at the wide portion of the die cavity hole of the die cavity sleeve 1, and R11=10 mm. A rounded corner is formed at the narrow portion of the die cavity hole of the die cavity sleeve 1. Specifically, On the left side of the Y axis, a rounded corner R13 is formed on the die cavity sleeve 1 at the position where the mandrel 2 and the short side of the second rectangular cavity form the narrow portion of the die cavity hole. On the right side of the Y axis, a rounded corner R14 is formed on the die cavity sleeve 1 at the position where the mandrel 2 and the short side of the second rectangular cavity form the narrow portion of the die cavity hole. Below the X axis, a rounded corner R12 is formed on the die cavity sleeve 1 at the position where the mandrel 2 and the long side of the second rectangular cavity form the narrow portion of the die cavity hole, and R12=R13=R14=15 mm. The angle a2 formed between two end faces of the die cavity sleeve 1 in the Z-axis direction is 1° to 2°. It is to be noted that the rounded corners chamfered at the wide portion of the die cavity hole is respectively small, and R1=10 mm. The rounded corners chamfered at the narrow portion of the die cavity hole is respectively large, and R12, R13 and R14=15 mm. Making the rounded corners chamfered at the narrow portion of the die cavity hole be large can effectively alleviate the pressure on the narrow portion of the die cavity hole, so as to avoid stress concentration and prolong service life of the die.

Specifically, the die cavity sleeve 1 is a cylinder. The angle formed between the two end faces of the die cavity sleeve 1 is 1° to 2°. When the blank material is subjected to hot extrusion, the blank material is in contact with the narrow portion of the die cavity hole first, so as to prevent the narrow portion of the die cavity hole from great deformation and strain during hot extrusion.

It is to be noted that, as shown in FIG. 5, the blank material will certainly be in contact with the lower portion of the die first when the blank material is extruded out, and the narrow portion of the die cavity hole is located at the lower portion, so the blank material is in contact with the lower portion first. When the angle is not provided between the two end faces of the die cavity sleeve 1, the blank material easily flows out from the wide portion of the die cavity hole, and there must be an inclined plane at the front end of the extrusion material. After the angle between the end faces is provided, the blank material is in contact with the narrow portion of the die cavity hole first and is extruded out, so that the front end of the extrusion material is a flat and straight plane, so as to reduce deformation.

The small rounded corner R11 chamfered at the wide portion of the die cavity hole of the die cavity sleeve 1 is 10 mm, and the large rounded corners R12, R13 and R14 chamfered at the narrow portion of the die cavity hole are all 15 mm, which reduces the extrusion resistance at the narrow portion of the die cavity hole and increases the resistance at the wide portion of the die cavity hole. In this way, the blank material can pass through the wide portion and the narrow portion of the die cavity hole uniformly, so that pulling stress is reduced to the minimum and the stress on the extrusion material is released uniformly.

The dimensions of L5, H3, L6, and H4 of the die cavity are enlarged to a certain extent uniformly, and the enlargement coefficient is 1.02 to 1.05. Enlarging the dimensions of L5, H3, L6, and H4 of the die cavity to a certain extent can solve the problem that the dimensions of L5, H3, L6, and H4 cannot meet a requirement caused by cooling shrinkage.

Embodiment 2

The present embodiment provides a hot extrusion integral forming method for a special-shaped square pipe, including the following steps:

step 1, heating and expanding the blank material;

step 2, heating the expanded blank material again;

step 3, performing hot extrusion on the blank material by the hot extrusion die for the special-shaped square pipe; and step 4, cooling the special-shaped square pipe formed by the hot extrusion, in the air, to a room temperature, and detecting the surface quality and mechanical properties of the special-shaped square pipe.

It is to be noted that, step 1 in the hot extrusion integral forming method for the special-shaped square pipe of the present disclosure further includes a step of preparing a blank material. The step of preparing the blank material includes the following specific processes.

Forged round steel is subjected to surface turning machining, saw-cutting, turning and grinding, and hole prefabricating. Process requirements are as follows: the outer surface of the round steel (blank material) is smooth and free of defect after turning machining, the surface roughness of the blank material is no more than 3.2 μm; the first end face and the second end face of the blank material after saw-cutting are machined by turning and grinding, the cutting inclination of the first end face and the second end face is no more than 2 mm, so as to ensure integrity of the extrusion material, the outer diameter of the machined blank material is 900 to 1000 mm, and a hole is prefabricated in the first end face. The hole is located at a circle center of the first end face. A trumpet opening is added to the first end face, an opening diameter of the trumpet opening is 235 to 240 mm, a depth thereof is 182 to 235 mm, an angle of the trumpet opening is 41 to 46°, and a diameter of the hole is 65 to 80 mm. Providing the trumpet opening and controlling the parameters of the trumpet opening can reduce the resistance during the hole expanding, and facilitate positioning of the hole expanding head, so that the wall thickness of the circular blank material after the hole expanding is consistent.

In step 1, heating and expanding the blank material includes preheating by an annular furnace (such as a resistance furnace), first induction heating and expanding.

In the abovementioned step 1, a specific process of the preheating by the annular furnace (such as the resistance furnace) is that: preheating is performed in the annular furnace at a heating rate of 50 to 100° C./h, the blank material is heated to 940 to 960° C. and preserved for 4 to 5 h. Using the annular furnace (such as the resistance furnace) and controlling the abovementioned preheating conditions to preheat can ensure uniformity of the heating temperature of the blank material, due to low heating rate of the resistance furnace.

In the abovementioned step 1, a specific process of the first induction heating is that: the blank material is heated to 1150 to 1180° C., and taken out of the furnace quickly.

In the abovementioned step 1, a specific process of the expanding is that: the heated blank material is subjected to hole expanding, the heated blank material is lubricated by glass powder before the hole expanding, a hole expanding head of 60/240 mm is selected, and the hole expanding speed is 100 to 250 mm/s. Performing the hole expanding on the heated blank material is to prepare an annular blank material for hot extrusion. The hole expanding head is selected to be matched with the abovementioned trumpet opening, which reduces the resistance during the hole expanding, and ensures relative uniform deformation of the blank material.

In step 2, the second heating treatment performed on the blank material after the hole expanding, includes heating by the annular furnace (such as a resistance furnace) and performing second induction heating.

In the abovementioned step 2, a specific process of heating by the annular furnace (the resistance furnace) is that: the expanded blank material is returned to the annular furnace (the resistance furnace) for heating, the heating rate is 50 to 100° C./h, the expanded blank material is heated to 940 to 960° C. and preserved for no less than 1 h. It is to be noted that, when the expanded blank material is taken away from a hole expander and conveyed to the annular furnace, the temperature of the expanded material drops, and there is a temperature difference between a surface and a core of the blank material. Compared with heating by the resistance furnace, the induction heating can result in larger local temperature difference and higher thermal stress. If an induction furnace is directly used for heating, the local temperature difference and the thermal stress are much higher, and local structures tend to be coarse easily at a high temperature, so the integral uniformity of the annular blank material structure cannot be guaranteed.

In the abovementioned step 2, a specific process of the second induction heating is that: in the second induction heating, the induction furnace heats the blank material to 1190 to 1220° C., and the blank material is taken out of the furnace quickly after the temperature thereof is equalized for 2 to 5 min.

In the abovementioned step 3, the heated blank material is fixed and subjected to hot extrusion by the hot extrusion die for the special-shaped square pipe. Before extruding, a center position of the hot extrusion die needs to be adjusted, mainly adjusting the relative positon between the die cavity sleeve 1 and the mandrel 2, so that the die cavity formed by the die cavity sleeve 1 and the mandrel 2 meets a previous dimension design. The dimension of the die cavity is measured by a plug gauge, so as to adjust the dimension of the die cavity in real time, reduce deformation of the extrusion material, and enable the extrusion material meet a design requirement. Glass powder is used for lubricating before extrusion, and the special-shaped die is used for extruding. The extrusion force is no more than 60 MN, and the extrusion speed is 100 to 300 mm/s.

It is to be noted that the present disclosure controls the extrusion force to be no more than 60 MN and the extrusion speed to be 100 to 300 mm/s, as the extrusion force is too high, it will exceed operation capacity of the equipment and the hot extrusion cannot be completed. At higher extrusion speed, for example, the extrusion speed is greater than 300 mm/s, the temperature of the blank material rises during deformation, so that the resistance to subsequent deformation is reduced and an extruder completes extrusion more easily.

In the abovementioned step 4, the special-shaped square pipe formed by the hot extrusion is cooled in air to a room temperature, and the surface quality and mechanical properties of the special-shaped square pipe are inspected.

Specifically, the extrusion material of the present disclosure is a high-strength stainless steel special-shaped square pipe. After hot extrusion, the extrusion material is cooled in air to a room temperature. The surface quality of a product is inspected after cooling, and the dimensions of key parts of the product are measured. Mechanical property and physical and chemical property tests are performed on the obtained high-strength stainless steel special-shaped square pipe.

In step 1, descaling treatment is performed before hole expanding, so as to remove scale from the surface of the blank material.

In step 3, descaling treatment is performed before hot extrusion, so as to remove scale from the surface of the blank material. During hot extrusion, a glass mat is used, an inner surface and an outer surface of the blank material are lubricated with the glass powder, which reduces the extrusion resistance.

It is to be emphasized that a general process route of the present disclosure is: blank material preparation→annular furnace (resistance furnace) preheating→first induction heating→hole expanding-annular furnace (resistance furnace) heating→second induction heating→hot extrusion→cooling→inspecting. According to the present disclosure, the annular furnace is used for preheating first and then the first induction heating is performed, and the annular furnace is used for heating and the second induction heating are performed again after hole expanding. Through heating by the annular furnace twice and performing induction heating twice respectively, the blank material heated by the annular furnace is heated uniformly, has small local temperature gradient and small thermal stress; however, much high heating temperature will greatly shorten the service life of some elements of the annular furnace; compared with resistance furnace heating, the blank material heated by the induction heating has larger local temperature difference and higher thermal stress. Heating the blank material first by the annular furnace and then by the resistance furnace can ensure the uniformity of the blank material.

Embodiment 3

In the example, the special-shaped square pipe is prepared by the hot extrusion die for the special-shaped square pipe provided by embodiment 1 and the hot extrusion integral forming method for the special-shaped square pipe provided by embodiment 2, including the following specific steps.

Step 1, Heating and Expanding the Blank Material

Firstly, the blank material is machined. A process is: forged round steel with grade of S45000 is subjected to surface turning machining, saw-cutting, turning and grinding, and hole prefabricating. Process requirements are as follows: the outer surface of the round steel is smooth and free of defect after turning machining, the roughness of the outer surface is no more than 3.2 μm, the end faces of the blank material after saw-cutting are machined by turning and grinding, the cutting inclination of the two end faces is no more than 2 mm, an outer diameter of the machined blank material is 900 to 1000 mm. A hole is prefabricated in one of the end faces. The hole is located at a circle center of the end face, a diameter of a trumpet opening is 235 mm, a depth of the trumpet opening is 200.23 mm, an angle of the trumpet opening is 46°, and a diameter of the hole is 65 mm.

Secondly, an annular furnace is used for preheating with a heating rate of 50° C./h, the blank material is heated to 950° C. and preserved for 4 h. After the heat preservation treatment, the blank material is heated by a first induction furnace for a first time, to 1180° C. and preserved for 1 min, and the blank material is taken out from the first induction furnace quickly after the heat preservation is ended.

Figure 2:
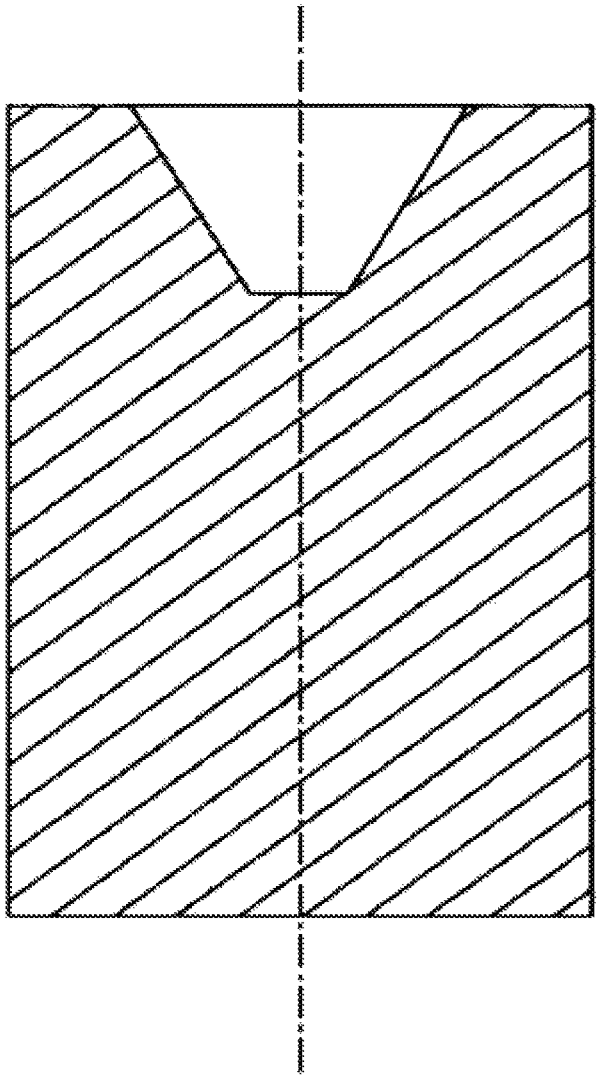
FIG. 2 is a schematic cross-sectional view of a blank material.

Thirdly, the blank material is expanded after leaving the first induction furnace, that is, the heated blank material is expanded. As shown in FIG. 2, the blank material is lubricated by the glass powder before expanding, a hole expanding head of 60/240 mm is selected, and the expanding speed is 180 mm/s.

Step 2, the blank material is heated for a second time after expanding, including heating by the annular furnace and heating by a second induction furnace. The blank material is returned to the annular furnace for heating after the expanding, the heating rate is 50° C./h, the blank material is heated to 950° C. and preserved for 1 h. The blank material is heated to 1200° C. by the second induction furnace and preserved for 2 min, and the blank material is taken out of the furnace quickly after the heat preservation is ended.

Step 3, hot extrusion is performed on the blank material by the hot extrusion die for the special-shaped square pipe.

The heated blank material is subjected to hot extrusion by the hot extrusion die provided by embodiment 1. Before extrusion, the blank material is lubricated by the glass powder, and extruded by the special die with an extrusion force of 48 MN and an extrusion speed of 250 mm/s.

Step 4, the special-shaped square pipe formed by the hot extrusion is cooled in air to a room temperature, and the surface quality and mechanical properties of the special-shaped square pipe are inspected.

Specifically, the extruded special-shaped square pipe is cooled in air to a room temperature after hot extrusion. The surface quality of a product is inspected and the dimensions of key parts of the product are measured. Mechanical property and physical and chemical property tests are performed on the obtained special-shaped square pipe.

The mechanical property tests are performed according to standards GB/T228 and GB/T230. Table 1 lists the actually measured mechanical properties of the product. The grain size is measured according to standard GB/T6394. Table 2 lists the actually measured physical and chemical property parameters. Table 3 lists the actually measured dimensions of the product, and the dimensions and tolerances meet the requirements of standard GB/T702.

TABLE 1

Mechanical Property Parameter Table of Special-Shaped Square Pipe

| Mechanical property parameter | Requirement | Measured value |
|---|---|---|
| Tensile strength/MPa | ≥800 | 935 |
| Yield strength/MPa | ≥550 | 752 |
| Elongation/% | ≥10 | 14 |
| Shrinking percentage of fracture surface/% | ≥50 | 73 |
| Impact Energy/J | ≥100 | 140, 142 |
| Hardness (HRC) | ≤30 | 28.1, 28.4, 28.2, 27.8 |

As shown in Table 2 and Table 3, the indexes, such as the surface quality, the physical and chemical properties, and the mechanical properties, of a high-strength stainless steel special-shaped square pipe prepared by the present disclosure all meet design requirements.

TABLE 2

Physical and Chemical Property Test Table of Special-Shaped Square Pipe

| Grain size test standard | Property parameter requirement | Actually measured value |
|---|---|---|
| GB/T6394 | ≥4 | 5 |

TABLE 3

Key Dimension Measurement Table of Special-Shaped Square Pipe

| Measuring position | Design requirement | Head of the special-shaped square pipe | 1500 mm from the head of the special-shaped square pipe | 3500 mm from the head of the special-shaped square pipe | 5500 mm from the head of the special-shaped square pipe | Tail of the special-shaped square pipe |
|---|---|---|---|---|---|---|
| L5 | $210^{4}_{0}$ mm | 212.1 | 212.3 | 212.5 | 212.5 | 212.4 |
| L6 | $230^{6}_{2}$ mm | 234.3 | 234.2 | 234.5 | 234.7 | 234.5 |
| H3 | $90^{3}_{0}$ mm | 91.2 | 91.3 | 91.6 | 91.5 | 91.6 |
| H4 | $120^{6}_{2}$ mm | 123.2 | 123.4 | 123.6 | 123.7 | 123.8 |

As shown in above Table 3, at the head of the special-shaped square pipe, the position of 1500 mm from the head of the special-shaped square pipe, the position of 3500 mm from the head of the special-shaped square pipe, the position of 5500 mm from the head of the special-shaped square pipe, and the tail of the special-shaped square pipe, the difference among the actual measurement dimensions of L5, L6, H3, and H4 is very small, the dimensions and tolerances meet the standard requirements of GB/T702, that is, the dimension accuracy of the prepared square pipe with a special-shaped cross section meets a design requirement.

The foregoing descriptions are merely preferred specific implementation of the present disclosure, but the protection scope of the present disclosure is not limited thereto. Variations or replacements readily figured out by those skilled in the art within the technical scope disclosed in the present disclosure shall fall within the protection scope of the present disclosure.

What is claimed is:

1. A hot extrusion die for a pipe, comprising a die cavity sleeve with a cavity, wherein a hot extrusion mandrel is arranged in the die cavity sleeve; an area between the die cavity sleeve and the hot extrusion mandrel forms a die cavity hole for the pipe;

a first extrusion diversion hole and a second extrusion diversion hole are arranged below the die cavity hole; the die cavity sleeve is shaped into a cylinder; a centroid of the die cavity hole is located at a circle center of a radial cross section of the die cavity sleeve; and an angle (a2) formed between a face, above the die cavity, of the die cavity sleeve and a face, below the die cavity, of the die cavity sleeve is in a range of 1° to 2°;

wherein an outer diameter of the die cavity sleeve is in a range of 415 mm to 416 mm; a three-dimensional Cartesian coordinate system is built on a radial cross section of the hot extrusion die with the circle center of the radial cross section of the die cavity sleeve as an original point, and has an X-axis direction in a transverse direction and a Y-axis direction in a longitudinal direction; a thickness of the die cavity sleeve in a Z-axis direction is in a range of 20 to 40 mm; both the die cavity sleeve and the mandrel are symmetrical about the Y axis; and the first extrusion diversion hole and the second extrusion diversion hole are arranged symmetrically about the Y axis; and wherein the cavity comprises a first rectangular cavity and a second rectangular cavity connected with each other; the first rectangular cavity is arranged above the second rectangular cavity, and a length of the first rectangular cavity is greater than that of the second rectangular cavity; and a convex portion is formed at a central position of a top of the first rectangular cavity, and a concave arc-shaped portion is formed at a central position of the convex portion.

2. The hot extrusion die according to claim 1, wherein first rounded corners (R1) and (R4) are formed at connections between the first rectangular cavity and the second rectangular cavity; a chamfer (a1) of 45° is formed at each of two sides of the top of the first rectangular cavity; second rounded corners are formed at two corners symmetric about the Y axis, at a bottom of the second rectangular cavity, and a size of the second rounded corners are 20.26 mm; and third equal rounded corners (R2), (R3), (R5), and (R6) are respectively formed at four corners of the mandrel, and a size of the third rounded corners (R2), (R3), (R5), and (R6) are all equal to 10.3 mm.

3. The hot extrusion die according to claim 1, wherein both the first extrusion diversion hole and the second extrusion diversion hole are circular holes; a radius of the first extrusion diversion hole and a radius of the second extrusion diversion hole are (R9) and (R10) respectively; the mandrel and a long side of the first rectangular cavity form a wide portion of the die cavity hole, and the mandrel and the second rectangular cavity form a narrow portion of the die cavity hole, and at a feeding end of the hot extrusion die, a fifth rounded corner (R11) is formed at the wide portion of the die cavity hole of the die cavity sleeve; and a sixth round corner is formed at the narrow portion of the die cavity hole of the die cavity sleeve, and a size of the sixth round corner is 15 mm.

4. A hot extrusion integral forming method for a pipe by using a hot extrusion die, wherein the hot extrusion mandrel is arranged in the die cavity sleeve; an area between the die cavity sleeve and the hot extrusion mandrel forms a die cavity hole for the pipe;

a first extrusion diversion hole and a second extrusion diversion hole are arranged below the die cavity hole; the die cavity sleeve is shaped into a cylinder; a centroid of the die cavity hole is located at a circle center of a radial cross section of the die cavity sleeve; and an angle (a2) formed between two end faces of the die cavity sleeve is in a range of 1° to 2°;

the method comprising following steps:

heating and expanding step for, performing heating and expanding on a blank material;

heating step for, heating the blank material again after the expanding;

hot extrusion step for, performing hot extrusion on the blank material with the hot extrusion die to form the pipe; and cooling step for, cooling the pipe formed by the hot extrusion, in air, to a room temperature, and inspecting surface quality and mechanical properties of the pipe;

wherein an outer diameter of the die cavity sleeve is in a range of 415 mm to 416 mm; a three-dimensional Cartesian coordinate system is built on a radial cross section of the hot extrusion die with the circle center of the radial cross section of the die cavity sleeve as an original point, and has an X-axis direction in a transverse direction and a Y-axis direction in a longitudinal direction; a thickness of the die cavity sleeve in a Z-axis direction is in a range of 20 to 40 mm; both the die cavity sleeve and the mandrel are symmetrical about the Y axis; and the first extrusion diversion hole and the second extrusion diversion hole are arranged symmetrically about the Y axis;

the cavity comprises a first rectangular cavity and a second rectangular cavity connected with each other; the first rectangular cavity is arranged above the second rectangular cavity, and a length of the first rectangular cavity is greater than that of the second rectangular cavity; and a convex portion is formed at a central position of a top of the first rectangular cavity, and a concave arc-shaped portion is formed at a central position of the convex portion.

5. The hot extrusion integral forming method according to claim 4, wherein in the heating and expanding step, an annular furnace is used for heating, a heating rate is 50 to 100° C./h, the blank material is heated to 940 to 960° C. and heat-preserved for 4 to 5 hr; and after heat preservation treatment, the blank material is heated to 1150 to 1180° C. by a first induction furnace and taken out from the first induction furnace.

6. The hot extrusion integral forming method according to claim 5, wherein in the heating and expanding step, the expanding is performed on the heated blank material by a hole expanding head of a 60/240 mm at a hole expanding speed of 100 to 250 mm/s.

7. The hot extrusion integral forming method for a pipe according to claim 5, wherein in the heating step, the heating comprises placing the expanded blank material into the annular furnace for heating, at a heating rate of 50 to 100°

C./h, the expanded blank material is heated to 940 to 960° C. and heat-preserved for no less than 1 hr; and after heat preservation treatment, the blank material is heated to 1190 to 1220° C. by a second induction furnace and taken out from the second induction furnace after a temperature of the blank material is equalized.

8. The hot extrusion integral forming method according to claim 7, wherein in the hot extrusion step, performing hot extrusion on the heated blank material with the hot extrusion die, wherein an extrusion force is no more than 60 MN, and an extrusion speed is in a range of 200 to 300 mm/s.

9. The hot extrusion integral forming method according to claim 4, wherein first rounded corners (R1) and (R4) are formed at connections between the first rectangular cavity and the second rectangular cavity; a chamfer (a1) of 45° is formed at each of two sides of the top of the first rectangular cavity; second rounded corners are formed at two corners symmetric about the Y axis, at a bottom of the second rectangular cavity, and a size of the second rounded corners are 20.26 mm; and third equal rounded corners (R2), (R3), (R5), and (R6) are respectively formed at four corners of the mandrel, and a size of the third rounded corners (R2), (R3), (R5), and (R6) are all equal to 10.3 mm.

10. The hot extrusion integral forming method according to claim 4, wherein both the first extrusion diversion hole and the second extrusion diversion hole are circular holes; a radius of the first extrusion diversion hole and a radius of the second extrusion diversion hole are (R9) and (R10) respectively; the mandrel and a long side of the first rectangular cavity form a wide portion of the die cavity hole, and the mandrel and the second rectangular cavity form a narrow portion of the die cavity hole; and at a feeding end of the hot extrusion die, a fifth rounded corner (R11) is formed at the wide portion of the die cavity hole of the die cavity sleeve; and a sixth round corner is formed at the narrow portion of the die cavity hole of the die cavity sleeve, and a size of the sixth round corner is 15 mm.

* * * * *